United States Patent [19]

Nassif

[11] Patent Number: 4,832,584

[45] Date of Patent: May 23, 1989

[54] ROTOR FOR PERISTALTIC PUMP

[75] Inventor: George Nassif, Rolling Meadows, Ill.

[73] Assignee: Corpak, Inc., Wheeling, Ill.

[21] Appl. No.: 144,484

[22] Filed: Jan. 15, 1988

[51] Int. Cl.[4] ..... F04B 43/12

[52] U.S. Cl. ..... 417/477; 417/474

[58] Field of Search ..... 417/474, 476, 477

[56] References Cited

U.S. PATENT DOCUMENTS

| | | | |
|---|---|---|---|
| 910,125 | 1/1909 | Graser . | |
| 1,335,672 | 3/1920 | Du Nouy . | |
| 1,635,373 | 9/1926 | Lofholm . | |
| 2,694,984 | 11/1954 | Daniels | 417/477 |
| 3,597,124 | 9/1969 | Adams | 417/477 |
| 4,025,241 | 5/1977 | Clemens | 417/474 X |
| 4,185,948 | 1/1980 | Maguire | 417/477 |
| 4,211,519 | 7/1980 | Hogan | 417/360 |
| 4,229,299 | 10/1980 | Savitz et al. | 417/477 |
| 4,288,205 | 9/1981 | Henk | 417/477 |
| 4,472,116 | 9/1984 | Wenstrup | 417/477 |
| 4,496,295 | 1/1985 | King | 417/477 |
| 4,515,584 | 5/1985 | Abe et al. | 417/477 X |
| 4,518,327 | 5/1985 | Hackman | 417/477 |
| 4,673,334 | 6/1987 | Allington et al. | 417/477 X |

FOREIGN PATENT DOCUMENTS

| | | | |
|---|---|---|---|
| 2276483 | 12/1976 | France | 417/477 |
| 58-170869 | 10/1983 | Japan | 417/477 |
| 0973924 | 11/1982 | U.S.S.R. | 417/477 |

*Primary Examiner*—Carlton R. Croyle
*Assistant Examiner*—Eugene L. Szczecina, Jr.
*Attorney, Agent, or Firm*—Wallenstein, Wagner & Hattis

[57] ABSTRACT

The invention is an improvement on rotors in peristaltic pumps for advancing enteral feeding solutions through medical tubing. The improvement comprises the provision of a plurality of removable, one-piece rollers disposed between the front and rear plates of a rotor. Each of the rollers is contained between a pair of vertically aligned, open channels provided in the front and rear plates. To permit free rotation of each roller within its respective pair of channels, an inner portion of each channel has dimensions slightly larger than the outer ends of each roller. To ensure that the rollers are, during normal use, retained within their respective channels, an outer portion of each channel has dimensions slightly smaller than the dimensions of the end of each roller. Each roller may be inserted or removed into its respective pair of channels by force-fitting the ends of that roller through the outer portion of each channel. Alternatively, the roller ends may be captured within a circular, closed channel within the front and rear plates. In this alternate embodiment, the rollers are removed by separating the front and rear plates.

6 Claims, 1 Drawing Sheet

ROTOR FOR PERISTALTIC PUMP

DESCRIPTION

1. Technical Field

The present invention generally relates to peristaltic pumps for advancing fluids through medical tubing at a predetermined delivery rate, and, in particular to an improved rotor for enteral feeding pumps.

2. Background Art

Peristaltic volumetric pumps are used in enteral feeding therapy to deliver, at a controlled rate, nutritional solution to a patient, through enteral tubing which is intubated within the patient. All embodiments of peristaltic pumps utilize a rotor of some type which imparts a pumping action to the fluid contained in a segment of the compressible tubing. In one type of peristaltic pump, the rotor comprises a disk-shaped body on which is carried a plurality of rollers which sequentially compress a segment of medical tubing as that tubing is contacted by the rollers. In prior art rotors of this type, as shown in FIGS. 1 and 1A, the rollers are comprised of a pin fixed to the rotor body over which is carried a rotatable sleeve. The rotors may be either concealed under a protective housing, or exposed as with the rotors used in the VTR 300 and CUB enteral pumps made by Corpak, Inc., Wheeling, Ill.

A problem with rotors having rollers of this sleeve/-pin construction is that during enteral feeding therapy, highly viscous feeding solution may leak or spill onto the rollers so that the spillage becomes trapped between the sleeve and pin. If not immediately serviced the spillage dries, thereby preventing the sleeve from rotating freely around the pin. This in turn causes inaccurate flow rates and, in some extreme instances, inoperability of the pump.

U.S. Pat. No. 4,229,299, issued on Oct. 21, 1980 to Savitz et al., and entitled "Peristaltic Dialysate Solution Pump," discloses one of the various prior art type of rollers. For example, FIGS. 7 and 8 and columns 26 and 27 of the Savitz patent disclose rollers having bearing surfaces 300 or 306 which are apparently rotatable about axle members 303 or 309, respectively. These are plainly two-piece rollers, and also do not have their tubing contact or bearing surface fixed to the underlying axle member.

U.S. Pat. No. 3,597,124, issued to Adams on Aug. 3, 1971, and entitled "Perastaltic (sic) Pump", also shows multi-piece roller-type structures. Particularly, these structures comprise a "roller 23 for rotation about an individual shaft 24." See FIGS. 3–5 and column 2, lines 1–4.

Both the Savitz and Adams pumps thus have roller constructions of the type apparently susceptible to the problems of spillage sought to be overcome by the present invention.

SUMMARY OF THE INVENTION

The invention is an improvement on rotors for peristaltic pumps that are used for advancing enteral feeding solutions through compressible medical tubing. These rotors are generally motor-driven, and have a plurality of independently rotating rollers, each of which is disposed between a front and a rear plate of that rotor. These rollers intermittently compress the tubing, and thereby advance the solutions contained within that tubing.

The improvement comprises the provision of a plurality of removable, one-piece rollers disposed between the front and rear plates. Each of the rollers is contained between a pair of vertically aligned, open channels provided in the front and rear plates.

To permit free rotation of each roller within its respective pair of channels, an inner portion of each channel has dimensions slightly larger than the dimensions of the end of each roller. To ensure that the rollers are, during normal use, retained within their respective channels, an outer portion of each channel has dimensions slightly smaller than the dimensions of the end of each roller. Each roller may be inserted or removed into its respective pair of channels by force-fitting the ends of that roller through the outer portion of each channel.

In another embodiment of the invention, the roller ends are captured in closed channels having a diameter greater than the diameter of the ends of the rollers. The rollers are trapped by a removable, vertical front or back plate containing the closed channels.

In another preferred embodiment of the invention, the rollers are not necessarily of one piece. Rather, the medical tubing contact surface is fixed to the remaining, underlying portion of the roller. In still another embodiment, the channels in the front and rear plates of the rotors have what may be characterized as a generally keyhole shape.

It may thus be seen that an object of the invention is an improved rotor for a peristaltic pump for use in enteral feeding which is reliable and whose rollers need not utilize sleeves of the type used in the prior art. Such a construction ensures that those rollers cannot bind to such overlying sleeves, even in the event that there is spillage of the enteral fluid onto those rollers. It is a further object of the invention to provide rollers which are readily removable from their rotor to facilitate their cleaning. It is yet another object of this invention to provide a construction aiding in the prevention of binding at the point where the roller meets and is supported by the rotor. It is another object of this invention to provide a peristaltic pump having a rotor with one-piece rollers, and in which the surface contacting the enteral feeding tube is an integral part of the roller.

DETAILED DESCRIPTION

Figure 1:
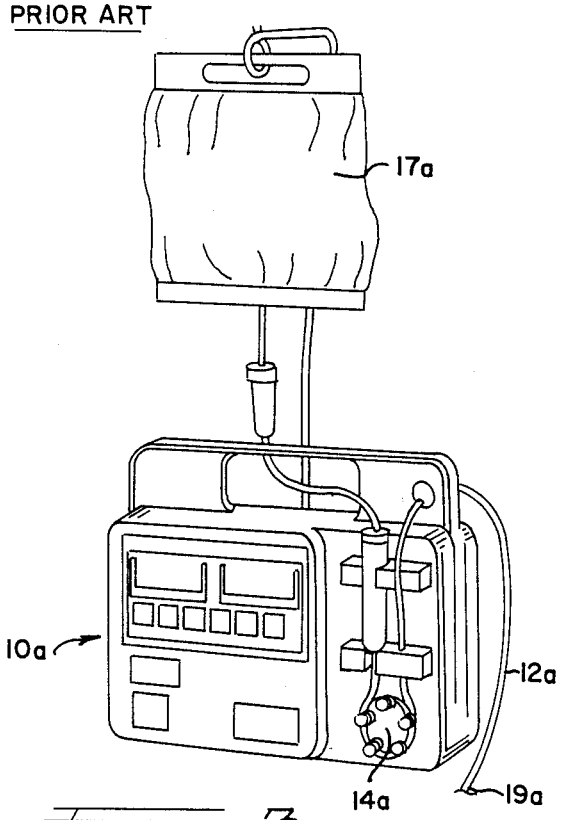
FIG. 1 PRIOR ART
FIG. 1 is a perspective view of a peristaltic pump of the prior art, including the motor driven rotor, medical tubing for the transport of an enteral or other solution, and independently rotating rollers including pins secured for rotation with the rotor, and sleeves secured for rotation about the rotor.

While this invention is susceptible of embodiment in many different forms, there is shown in the drawings and will herein be described in detail a most preferred embodiment of the invention. It should be understood that the present disclosure is to be considered as an exemplification of the principles of the invention, and is not intended to limit the broadest aspects of the invention to the embodiment or embodiments illustrated.

Figure 1A:
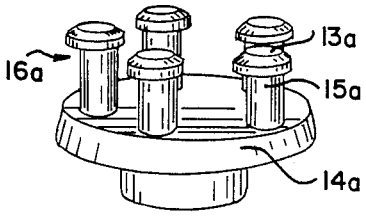
FIG. 1A PRIOR ART

Referring now to the FIGURES, FIGS. 1 and 1A show a peristaltic pump 10*a* of the prior art, and of the general type to which the present improvement invention is directed. The prior art pump includes a motor-driven impeller or rotor 14*a* which typically rotates about a horizontally-disposed motor shaft. The rotor 14*a* includes a plurality of independently rotating rollers 16*a*, each of which is comprised of an underlying pin 13*a* and a sleeve 15*a*. The roller 16*a*, and particularly its sleeve 15*a*, acts upon enteral or other fluids within compressible medical tubing 12*a*. Particularly, two adjacent rollers 16*a* and their sleeves 15*a* contact and thereby compress a short section of the tubing 12*a*, trapping the contained liquid. As the sleeves 15*a* rotate with rotor 14*a*, they move the contained liquid in the direction of the rotation. For example, in FIG. 1, the rotor 14*a* would rotate in a counterclockwise direction to move the liquid from the enteral feed bag 17*a* to the distal end 19*a* of the medical tubing 12*a* and then to the patient.

Pins 13*a* are typically staked into and do not rotate relative to the rotor 14*a*. However, sleeves 15*a* are not secured to and thus are rotatable about pins 13*a*.

The present invention, as shown in FIGS. 2–6A, avoids the problems of this prior art, including the aforementioned problems attributable to spillage of fluids onto the rotor and its rollers.

Figure 2:
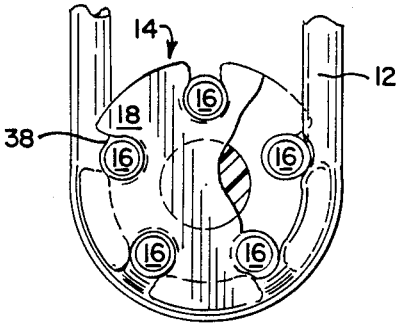
FIG. 2 is a frontal view, partially in section, of a motor-driven rotor mounted on a peristaltic pump, including five one-piece rollers, in accordance with one preferred embodiment of the invention, and showing the rollers acting upon a fluid-filled section of compressible medical tubing.
Figure 6:
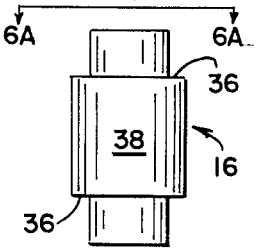
FIG. 6 is a side view of the one-piece rollers of FIGS. 2–4.
Figure 6A:
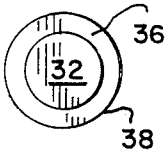
FIG. 6A is a frontal view, taken along lines 6A—6A of FIG. 6, of the one-piece rollers of FIGS. 2–4.

Referring now to FIG. 2, the motor-driven rotor 14 of the present invention includes five removable, one-piece, independently rotating rollers 16. One example of rollers in accordance with the invention is shown in FIGS. 6 and 6A.

Figure 3:
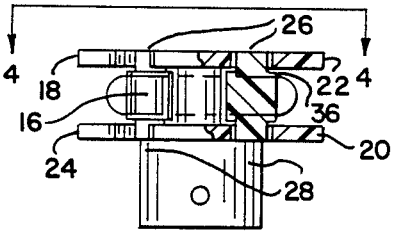
FIG. 3 is a side view, partially in section, of the rotor of FIG. 2, but removed from the peristaltic pump.

As may be seen from FIGS. 2 and 3, the rotor includes a front plate 18 and a rear plate 20. In several important aspects, the front and rear plates are identical. Particularly, both the front 18 and rear plates 20 have the same general shape. That shape is generally similar to that of the front plate 18 shown in the rotor 14 of FIG. 5.

The peripheral edge 22 of front plate 18 is interrupted by five channels 26. In addition, the peripheral edge 24 of rear plate 20 is interrupted by five channels 28. As may best be seen in FIG. 5, the channels 26, like channels 28, are of a generally keyhole-type shape.

Channels 26 in front plate 18, as may be seen in FIG. 3, are vertically aligned with channels 28 in rear plate 20 to thereby cooperatively define a pair of channels, each pair carrying one of the removable, one-piece rollers 16.

The dimensions of channels 26 and 28 are largely dependent on the dimensions of the rollers 16. Particularly, the inner portion 30 of the channel should be sufficiently larger than the end 32 of roller 16 that the roller 16 can rotate freely within that inner portion 30. This free rotation should be possible even in the event of spillage and drying of enteral fluid upon the surfaces defining that inner portion 30.

The dynamics of the present invention, which ensure continued free rotation even in the event of spillage and drying of enteral fluid, are believed to result from the relative diameters of the end 32 of the roller and the inner portion 30 of the channels. There is a relatively loose fit of the end 32 of the roller within inner portion 30. Thus, as the rotating roller 16 itself contacts the compressible medical tubing, it moves freely within and is forced against the far perimeter of that inner portion 30.

This free movement aids in accomplishing the objects of the invention in two ways. First, it permits the end of the roller to physically break away from any spilled solution that may have dried upon both it and the periphery of the inner portion, and negates any tendency of the dried, spilled solution to bind the roller to this periphery. This free movement also permits the end of the roller to forcibly and mechanically strike the periphery of the inner portion, which has a cleaning effect on that periphery.

In a most preferred embodiment in accordance with the present invention, the inner portion 30 of the channel has a diameter of 0.180 inches. The end 32 of the roller has a diameter of 0.150 inches. Thus, the ratio of the diameter of the inner portion 30 to the diameter of the end 32 of the roller is 0.180/0.150, or 1.20. In this most preferred embodiment, then, the diameter of the inner portion 30 exceeds the diameter of the end 32 of the roller by twenty percent (20%).

The diameter of the inner portion should most preferably exceed that of the end 32 of the roller by 15 to 25 percent. However, it should be borne in mind that any ratio of inner portion diameter to roller end 32 diameter which ensures that the roller itself will not bind upon spilling and drying of enteral fluid onto the inner portion's defining surfaces will come within the broadest scope of the present invention.

The rollers 16 and rotor 14 may be of any suitable material, but are preferably manufactured of a relatively hard injection-moldable plastic, or a machined plastic or metal. The plastic should be somewhat flexible, enabling, for example, the surfaces defining an outer portion 34 of the channel 26 to move away from each other under applied stress.

The outer portion 34 of the channel is sized smaller than the diameter of the end 32 of the roller to ensure retention of the rollers 16 within the inner portion 30. Through long use or abuse, rollers 16 may wear out or be inadvertently broken. Moreover, the rollers 16 could be soiled by enteral fluids or other deleterious substances.

Figure 5:
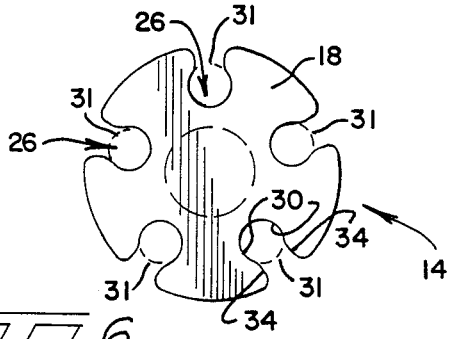
FIG. 5 is a frontal view of the front plate of the rotor of FIGS. 2–4 but without the one-piece rollers, and particularly showing both the details of the keyhole-shaped channels which contain the rollers, and, in phantom, the details of a second embodiment in which the roller ends are captured in closed channels.
Figure 4:
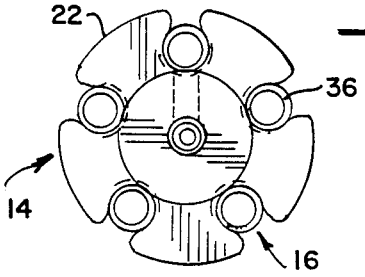
FIG. 4 is a frontal view, taken along lines 4—4 of FIG. 3, of the motor-driven rotor in accordance with one embodiment of the invention and including five one-piece rollers.

To aid in the cleaning or replacement of the rollers 16, the outer portion 34 is preferably sized to permit a snap or interference fit. Hence, the rollers 16 may be removed through that outer portion 34 by forcing or prying them outwardly with a hard tool. Under the stress of this force, the surfaces defining the outer portion 34 of the channel 26 move away from each other, permitting the rollers 16 to pass. When this stress is removed, the surfaces of this outer portion 34 return to their normal position as shown in FIG. 5. In the most preferred embodiment described above, the outer portion 34 has a normal, unstressed dimension of 0.140 inches.

Similarly, a new roller 16 may be replaced within its corresponding pair of channels 26 and 28 by force-fitting that roller through the outer portion 34 of those channels.

As indicated above, a second embodiment in accordance with this invention comprises a construction having closed channels, as partially depicted in the phantom lines of FIG. 5. In this second embodiment, the channels are not of a generally keyhole shape. Rather, the channels in both the front 18 and rear plates 20 are round in shape. Referring now to FIG. 5, these round channels are defined by (1) the solid lines defining the periphery of what has been previously referred to as the inner portion 30 of the channel, and (2) the phantom lines 31. In this embodiment, there is no outer portion 34 of the channel; thus, in the round embodiment, the solid lines of FIG. 5 defining the outer portion 34 of the channel do not exist.

In combination, these lines define a circular channel having, in one preferred embodiment, a diameter of 0.180 inches. The ends of the rollers, with a diameter of 0.150 inches, are captured within these circular channels.

To enable removal of rollers, either the front 18 or back plate 20 are removable. Removal may facilitated by a snap-fitting relationship between the front and back plates. Alternatively, the front and back plates may be secured to one another by screw means or the like.

As may be seen in FIGS. 3, 6, and 6A, each roller in either of these two embodiments has a central diameter that is somewhat larger than the diameter of its two ends 32. In the most preferred embodiments, the central diameter of the roller is 0.250 inches. These differences in diameter result in the formation of a pair of shoulders 36. The shoulders 36 abut against the inwardly-facing surfaces of the front 18 and rear plates 20, preventing the rollers 16 from moving laterally out of their proper position between those plates.

In the above preferred embodiment, the rollers have been described as "one-piece." It should be apparent to those skilled in the art that rollers which are not strictly of one piece, but which are of a modified multiple piece construction, are within the scope of this invention. "Modified multiple piece construction," as that expression is used in this specification, means any construction of more than one piece where the various pieces are mechanically or chemically bonded together so that there is no relative movement between those pieces.

It should be apparent to those skilled in the art that such a modified multiple piece construction would attain the advantages of the present invention, and that such construction would be essentially equivalent to the one piece construction described in the above preferred embodiment. For example, a modified multiple piece construction would not be subject to the binding of prior art devices caused by the interference of dried enteral fluids between a stationary roller pin 13*a* and its relatively movable sleeve 15*a*. This modified multiple piece construction would, by definition, have no relative movement between its elements. Moreover, any potentially fluid-entrapping spaces between such elements would presumably be filled by the mechanical or chemical bonding medium, such as a weld or adhesive.

In summary, then, and in the context of the present specification, the essential characteristic of the invention is that the roller 16 have a medical tubing contact surface which is fixed to the remaining, underlying portion of the roller 16. Thus, in the one-piece roller 16 shown in the preferred embodiment and depicted in FIGS. 2–6A, the medical tubing contact surface 38 is an integral part of and therefore plainly fixed to the remaining, underlying portion of the roller 16.

In contrast, in a multiple piece roller, such as the two-piece, prior art roller 16*a* as shown in FIGS. 1 and 1A, the tubing contact surface is the sleeve 15*a*. In order for that roller 16*a* to have a tube contact surface, or sleeve 15*a*, which is fixed to the remaining, underlying portion of the roller, or pin 13*a*, within the meaning of that expression in this specification, the sleeve would need to be mechanically or chemically bonded to that pin so that there could be essentially no gap between those elements and, more critically, no possibility of relative movement between those elements.

While the specific embodiments have been illustrated and described, numerous modifications come to mind without markedly departing from the spirit of the invention and the scope of protection is only limited by the scope of the accompanying claims.

What I claim is:

1. In a peristaltic pump for advancing enteral feeding solutions through medical tubing, the pump including a motor driven rotor, the rotor carrying a plurality of independently rotating rollers for intermittently compressing the tubing to advance the solutions therein contained, the rotor having a front plate and a rear plate with the rollers being disposed therebetween, an improved rotor comprising:

peripheral edges of the front and rear plates of the rotor being selectively configured to define a plurality of open channels, the channels on the top and bottom plates being vertically aligned to define pairs of channels, each pair of channels carrying a removable roller, said roller having a medical tubing contact surface which is fixed to the remaining, underlying portion of said roller, an inner portion of each channel having dimensions slightly larger than the dimensions of each end of the rollers to permit free rotation of the rollers within the channel, an outer portion of the channel having dimensions slightly smaller than each end of the rollers to normally retain the rollers within the inner portion of the channel, such that each roller is inserted into a pair of channels by force-fit through the outer portion of each channel.

2. The improved peristaltic pump rotor set forth in claim 1, wherein said roller is a one-piece roller and wherein said medical tubing contact surface is an integral part of said roller.

3. The improved peristaltic pump rotor set forth in claim 1, wherein said channels are of a generally keyhole shape.

4. The improved peristaltic pump rotor set forth in claim 2, wherein said channels are of a generally keyhole shape.

5. The improved peristaltic pump rotor set forth in claim 1, wherein the diameter of said inner portion of said channel exceeds the diameter of said end of said roller by from 15 to 25 percent.

6. The improved peristaltic pump rotor set forth in claim 2, wherein the diameter of said inner portion of said channel exceeds the diameter of said end of said roller by from 15 to 25 percent.

* * * * *

UNITED STATES PATENT AND TRADEMARK OFFICE

CERTIFICATE OF CORRECTION

PATENT NO. : 4,832,584

DATED : May 23, 1989

INVENTOR(S) : George Nassif

It is certified that error appears in the above-identified patent and that said Letters Patent is hereby corrected as shown below:

In Column 5, line 25, delete "are" and insert therefor --is--.

In Column 5, line 25, insert between the words "may" and "facilitated" the word --be--.

Signed and Sealed this

Thirteenth Day of February, 1990

*Attest:*

JEFFREY M. SAMUELS

*Attesting Officer* *Acting Commissioner of Patents and Trademarks*